US010698342B2

(12) United States Patent
Sabo et al.

(10) Patent No.: US 10,698,342 B2
(45) Date of Patent: Jun. 30, 2020

(54) ANTI-FRICTION RING FOR A DEVELOPER ROLLER IN A LIQUID ELECTROPHOTOGRAPHIC PRINTER

(71) Applicant: HP Indigo B.V., Amstelveen (NL)

(72) Inventors: David Sabo, San Diego, CA (US); Yehonatan Lugassy, Ness Ziona (IL); Roman Katz, Ness Ziona (IL)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 16/464,702

(22) PCT Filed: Jan. 31, 2017

(86) PCT No.: PCT/EP2017/052073
§ 371 (c)(1),
(2) Date: May 29, 2019

(87) PCT Pub. No.: WO2018/141370
PCT Pub. Date: Aug. 9, 2018

(65) Prior Publication Data

US 2019/0346791 A1 Nov. 14, 2019

(51) Int. Cl.
*G03G 15/08* (2006.01)
*G03G 15/10* (2006.01)

(52) U.S. Cl.
CPC ..... *G03G 15/0817* (2013.01); *G03G 15/10* (2013.01); *G03G 2215/0877* (2013.01)

(58) Field of Classification Search
CPC ..... G03G 15/0817
USPC ..... 399/103
See application file for complete search history.

(56) References Cited

U.S. PATENT DOCUMENTS

| | | | | |
|---|---|---|---|---|
| 5,576,815 | A * | 11/1996 | Teschendorf | G03G 15/101 399/249 |
| 6,980,752 | B2 | 12/2005 | Kamimura | |
| 7,155,151 | B2 | 12/2006 | Okamoto | |
| 7,742,718 | B2 | 6/2010 | Hashizume et al. | |
| 8,045,882 | B2 | 10/2011 | Delcamp et al. | |
| 9,250,572 | B2 | 2/2016 | Karp et al. | |
| 2002/0141777 | A1 | 10/2002 | Kamimura et al. | |
| 2004/0005174 | A1* | 1/2004 | Park | G03G 15/104 399/237 |
| 2007/0253727 | A1 | 11/2007 | Hashizume et al. | |

FOREIGN PATENT DOCUMENTS

JP 08113334 A * 5/1996

OTHER PUBLICATIONS

Josiah, M., Remanufacturing the Brother HI 4150 Series Toner Cartridges Tn-310/315 Color Toner Cartridges, Nov. 8, 2012.

* cited by examiner

*Primary Examiner* — Quana Grainger
(74) *Attorney, Agent, or Firm* — Dierker & Kavanaugh PC

(57) ABSTRACT

In one example, a sealing system for a developer roller in a liquid electrophotographic printer includes a pair of arcuate seals each with an annular sealing surface to seal one end of the developer roller; a pair of washers each having a low friction surface to contact one of the sealing surfaces; and a pair of retainers each to hold one of the washers flat against the end of the roller.

11 Claims, 5 Drawing Sheets

ANTI-FRICTION RING FOR A DEVELOPER ROLLER IN A LIQUID ELECTROPHOTOGRAPHIC PRINTER

BACKGROUND

Liquid electrophotographic (LEP) printing uses a special kind of ink to form images on paper and other print substrates. LEP ink usually includes charged polymer particles dispersed in a carrier liquid. The polymer particles are sometimes referred to as toner particles and, accordingly, LEP ink is sometimes called liquid toner. An LEP printing process involves placing an electrostatic pattern of the desired printed image on a photoconductor and developing the image by presenting a thin layer of LEP ink to the charged photoconductor. The ink may be presented to the photoconductor with a roller that is commonly referred to as a "developer roller." Charged toner particles in the ink adhere to the pattern of the desired image on the photoconductor. The ink image is transferred from the photoconductor to a print substrate, for example through a heated intermediate transfer member that evaporates much of the carrier liquid to dry the ink film before it is transferred to the print substrate.

DRAWINGS

The same part numbers designate the same or similar parts throughout the figures. The figures are not necessarily to scale.

DESCRIPTION

In liquid electrophotographic printing, a thin film of LEP ink is applied to the exterior of a developer roller and then presented to a photoconductor at a nip between the developer roller and the photoconductor. In some developer units, foam seals are pressed against the face at each end of the developer roller to prevent ink leaking off the ends of the roller. The developer roller rotates at high speed during operation. Friction between the seal and the rotating roller can tear the foam seals and generate heat that can damage the ink.

A new sealing system has been developed to reduce friction between the seals and the ends of the developer roller. In one example, the sealing system includes a pair of PTFE (polytetrafluoroethylene) or other low friction washers, each pre-flexed with a concave shape (bowed out at the center of the washer), and a corresponding pair of push-on retainers to flatten and hold the washers against the ends of the developer roller. Each retainer is pushed onto the roller shaft to secure the corresponding washer against the end of the roller. The seals are then pressed against the outboard face of the PTFE washers to reduce friction between the seals and the developer roller. Pre-flexing the washers with an outward bow helps enable a thinner washer to stay flat for a good seal.

These and other examples shown in the figures and described below illustrate but do not limit the scope of the patent, which is defined in the Claims following this Description.

As used in this document, "low friction" means a coefficient of friction less than 0.3.

Figure 1:
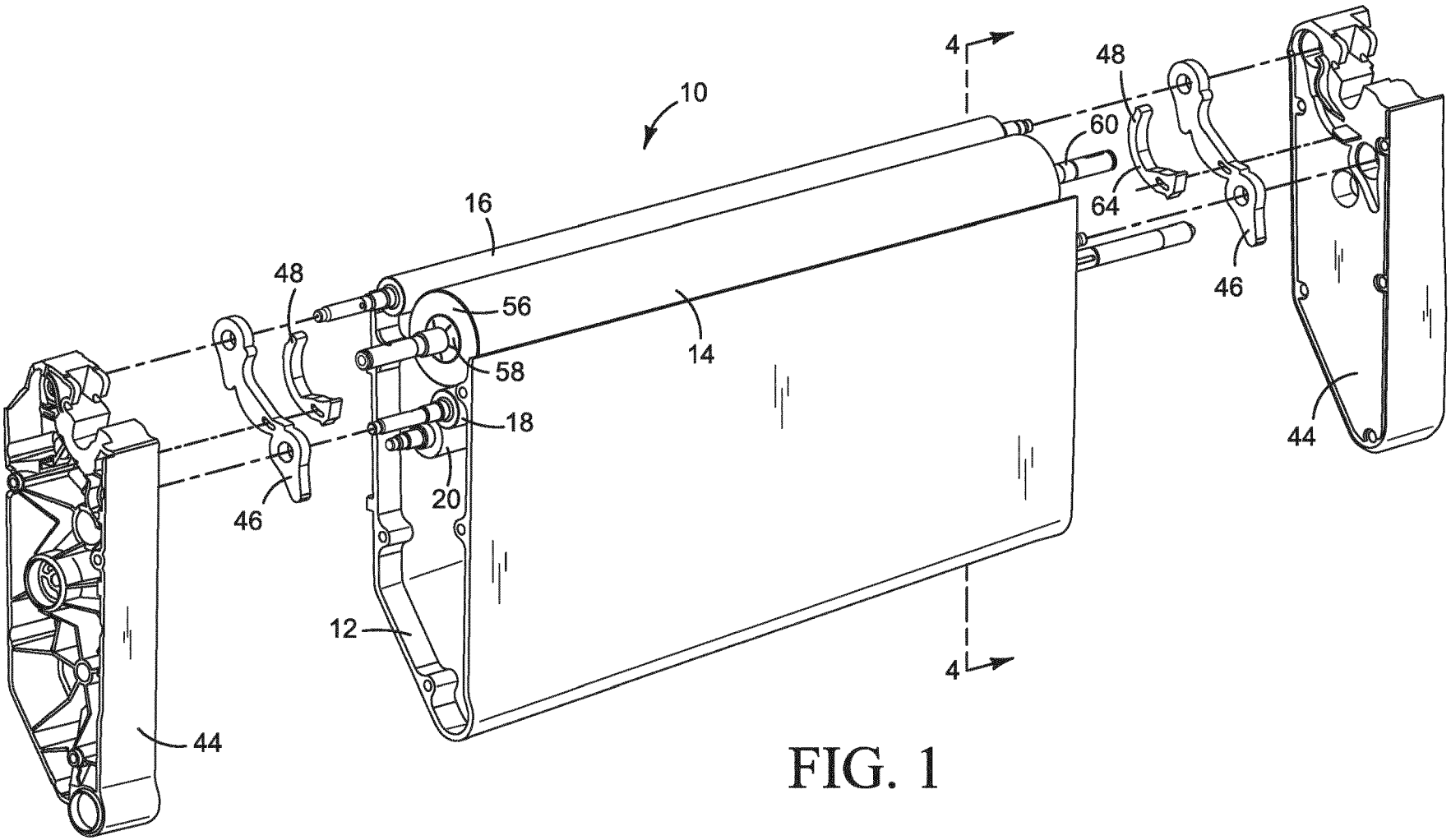
FIG. 1 is an isometric, partially exploded view illustrating one example of a developer unit for liquid electrophotographic printing.
Figure 2:
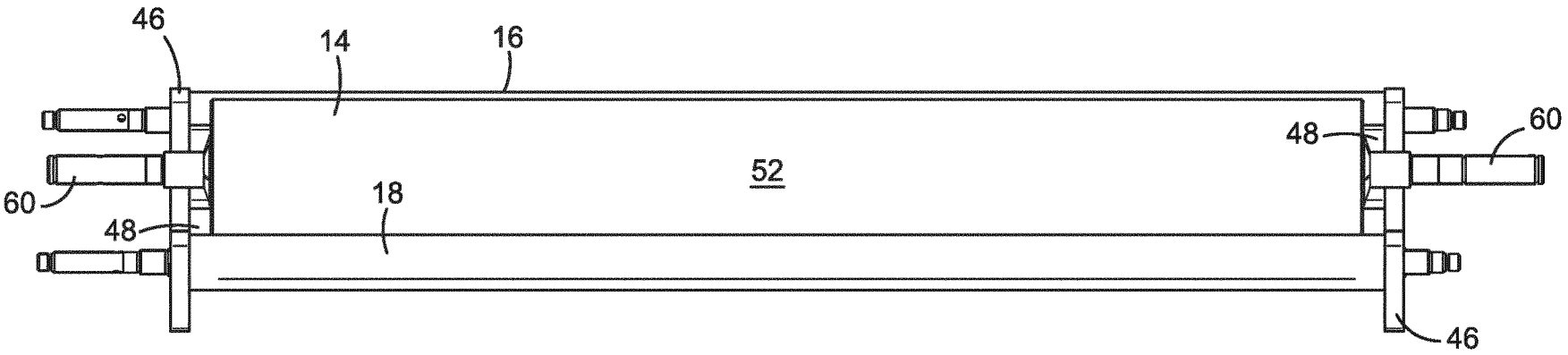
FIGS. 2 and 3 are elevation and isometric views, respectively, showing rollers and seals from the developer unit in FIG. 1.
Figure 3:
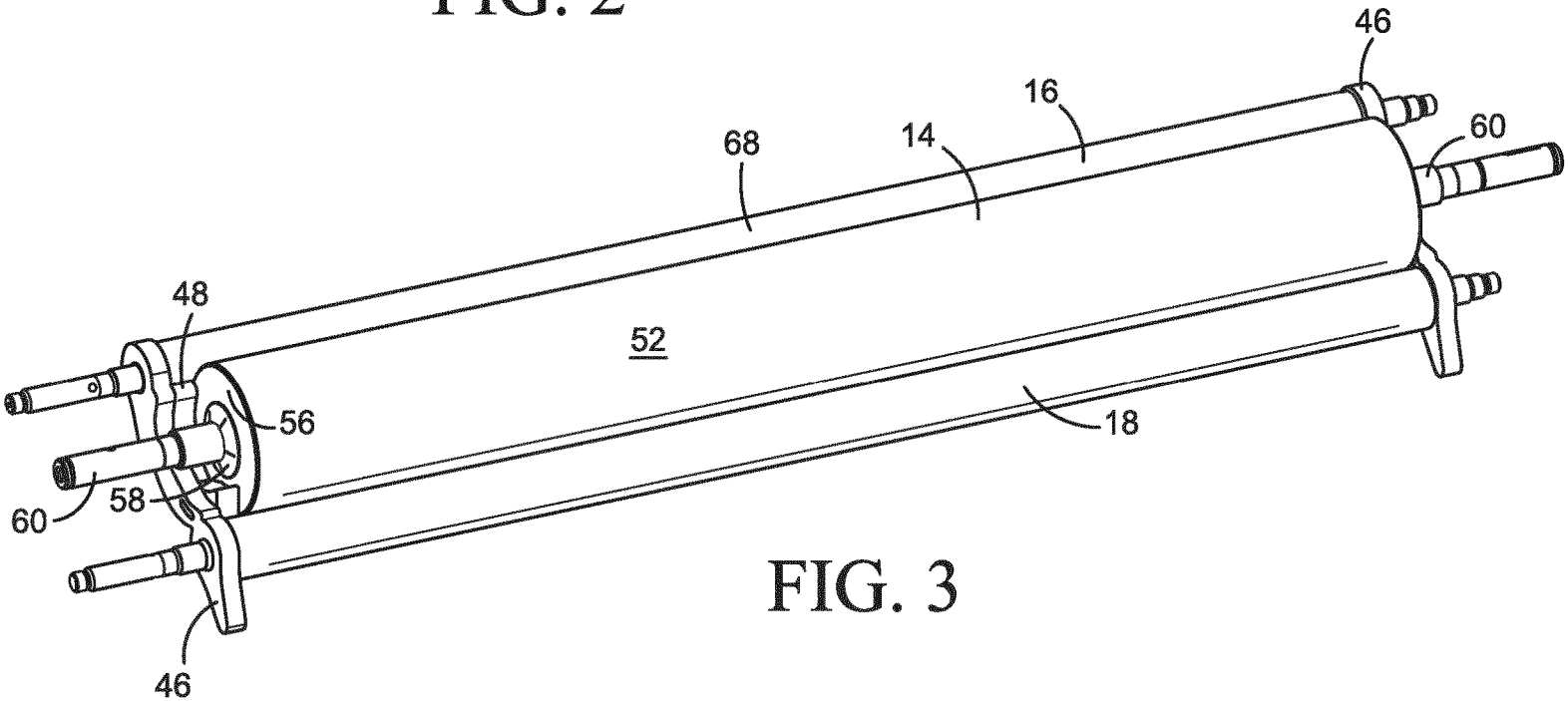
Figure 4:
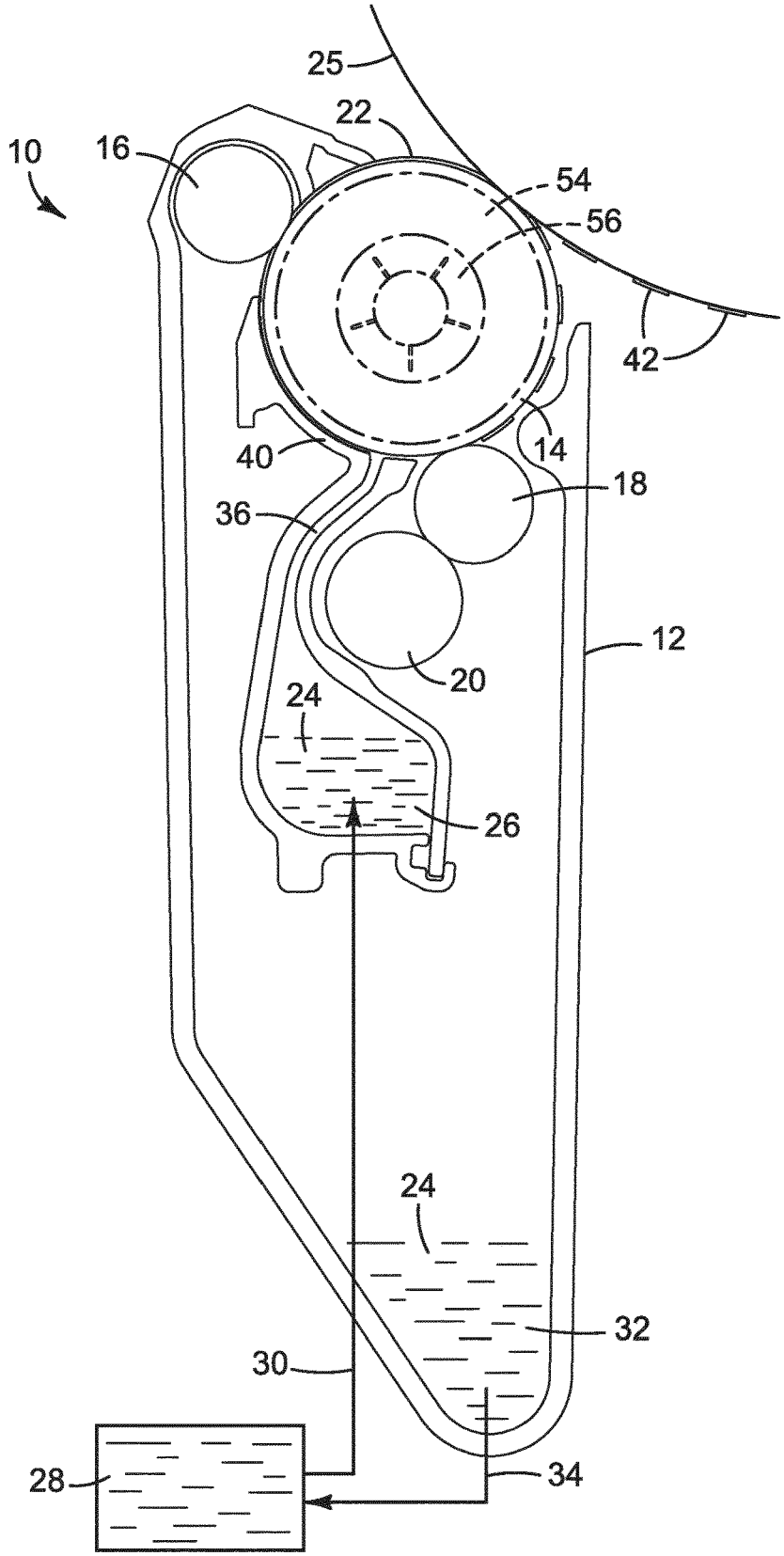
FIG. 4 illustrates one example of a section along the line 4-4 in FIG. 1.
Figure 5:
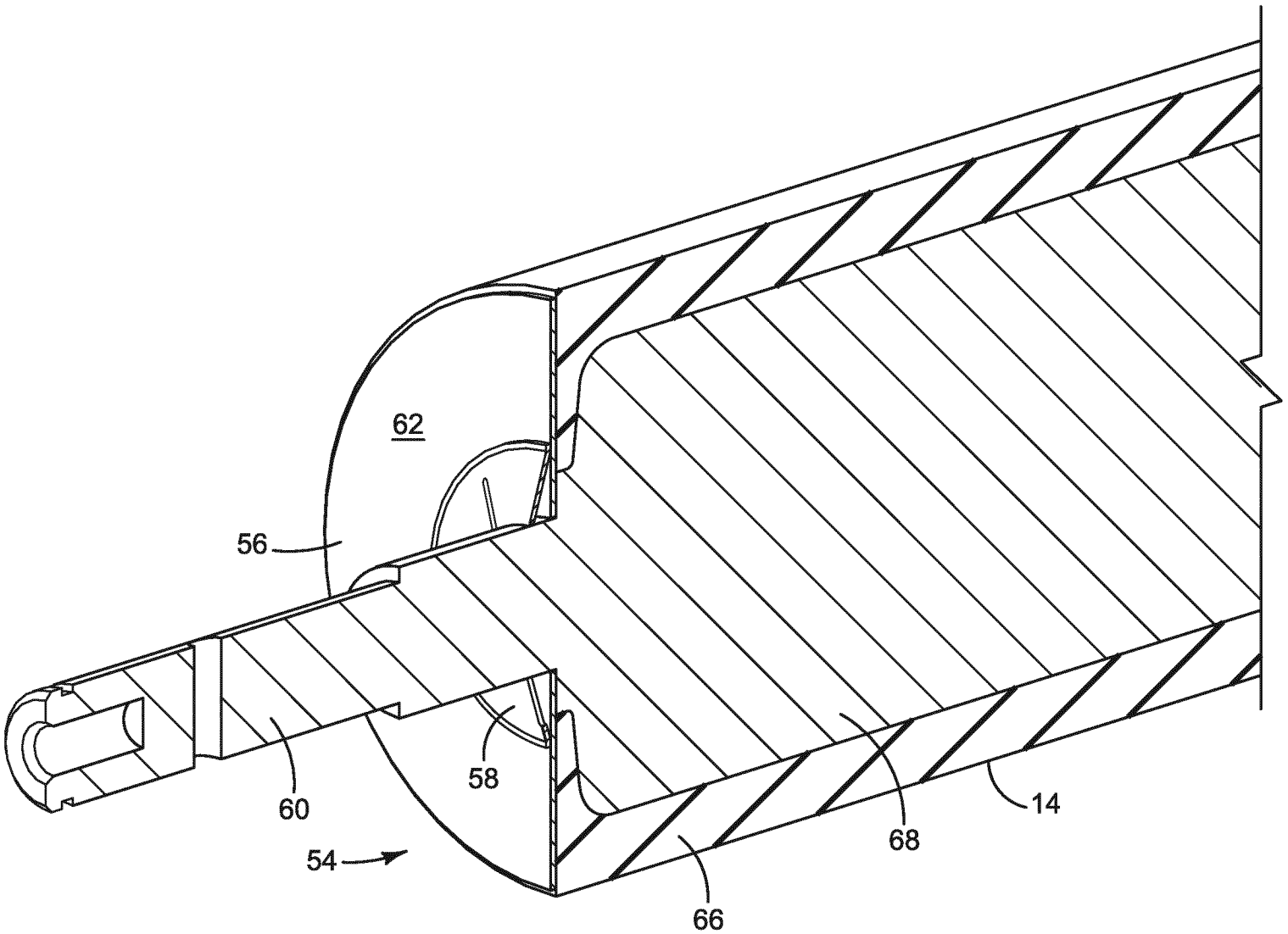
FIG. 5 is an isometric section view showing one example of a developer roller assembly in the developer unit of FIG. 1.
Figure 6:
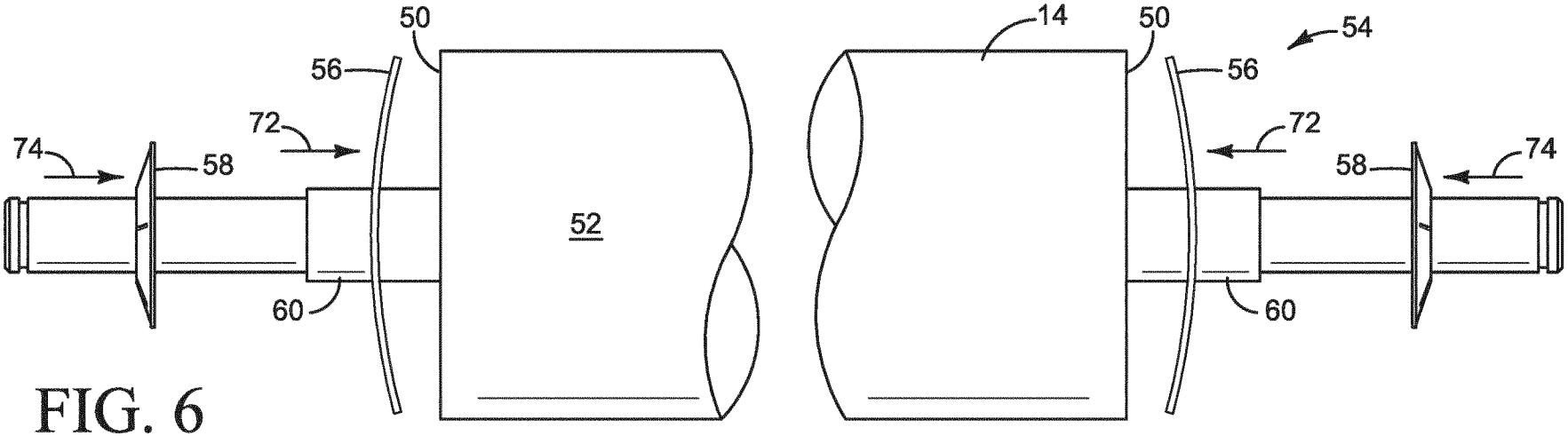
FIGS. 6 and 7 are elevation views showing an installation sequence for anti-friction rings in the example roller assembly of FIG. 5.
Figure 7:
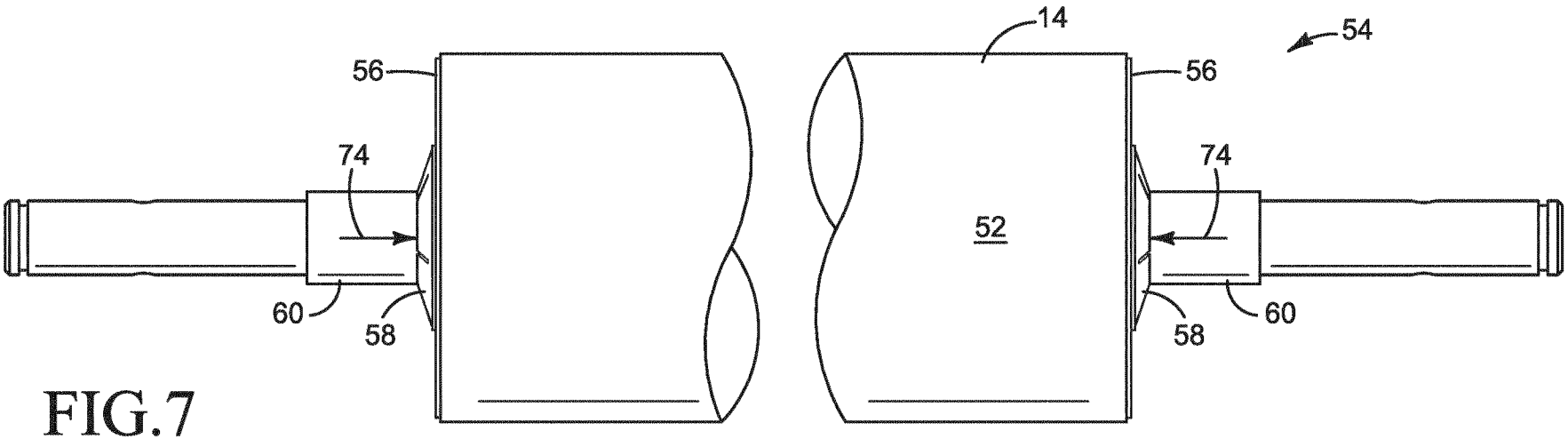

FIG. 1 is an isometric, partially exploded view illustrating one example of a developer unit 10 for a liquid electrophotographic printer. FIGS. 2 and 3 are elevation and isometric views, respectively, showing roller assemblies and seals from developer unit 10 in FIG. 1. FIG. 4 illustrates one example of a section along line 4-4 in FIG. 1. Hatching is omitted and some of the parts are simplified in FIG. 4 for clarity. FIGS. 5-7 are detail views showing one example of a developer roller assembly with anti-friction rings and retainers in more detail. A developer unit for an LEP printer is commonly referred to as a "binary ink developer" or a "BID." An LEP printer may include multiple BIDs, one for each color ink for example.

Referring first to FIGS. 1-4, developer unit 10 includes a housing 12 housing a developer roller 14, a squeegee roller 16, a cleaner roller 18, and a sponge roller 20. Referring specifically to FIG. 4, developer roller 14 is exposed outside housing 12 to present a film 22 of LEP ink 24 to a photoconductor 25. LEP ink 24 may be pumped to a local supply chamber 26 in developer unit 10 from an external reservoir 28 through an inlet 30. Also, excess ink 24 may be reclaimed and collected in a local return chamber 32 and returned to reservoir 28 through an outlet 34. In operation, according to one example, supply chamber 26 is pressurized to force ink 24 up through a channel 36 to the electrically charged developer roller 14. A thin layer of ink is applied electrically to the surface of a rotating developer roller 14 along an electrode 40. Squeegee roller 16 rotates along developer roller 14 to squeegee excess carrier liquid from the ink on roller 14 while charged particles in the ink continue to adhere developer roller 14.

The now more concentrated ink film 22 on developer roller 14 is presented to photoconductor 25 where some of the ink is transferred in the pattern of a latent electrostatic image on the photoconductor as the desired ink image 42. A charged cleaner roller 18 rotates along developer roller 14 to electrically remove residual ink from roller 14. In this example, cleaner roller 18 is scrubbed with a "sponge" roller 20 that is rotated against cleaner roller 18. Some of the ink residue may be absorbed into sponge roller 20 and some may fall away. Excess carrier liquid and ink drains to return chamber 32 where it can be recycled to reservoir 28.

As shown in FIG. 1, developer unit 10 includes end caps 44 attached to housing 12 to support each roller 14-20 on its respective shaft. As shown in FIGS. 1-3, a pair of first face seals 46 between end caps 44 and the ends of squeegee roller 16 and cleaner roller 18 help prevent ink from leaking past the ends of rollers 16, 18. A pair of second face seals 48 between end caps 44 and the ends 50 (FIG. 6) of developer roller 14 help prevent ink from leaking off the circular outer surface 52 past the ends of roller 14. In this example, developer roller 14 is shorter than squeegee roller 16 and cleaner roller 18 and each developer roller face seal 48 is located inboard from each squeegee/cleaner roller face seal 46.

Referring now to FIGS. 5-7, a developer roller assembly 54 includes developer roller 14, anti-friction rings 56, and retainers 58 on roller shafts 60. Each anti-friction ring 56 is constructed as a thin flat disk, commonly referred to as a "washer", with a low friction outboard surface 62. Each washer 56 encircles roller shaft 60 at one end 50 of roller 14 with low friction surface 62 facing the annular sealing surface 64 on seal 48 (FIG. 1). Low friction surface 62 is made of polytetrafluoroethylene (PTFE) or another suitably low friction material to reduce friction between the ends 50 of roller 14 and face seals 48. In some examples, each ring 56 is stamped or otherwise formed as a single part made of low friction material. In other examples, surface 62 on each ring 56 is formed as a low friction coating on a base material.

In the example shown in FIG. 5, developer roller 14 is constructed with a polyurethane or other suitably compliant exterior 66 on a metal core 68. Exterior 66 wraps around the ends of core 68 and ring 56 abuts exterior 66 and the protruding core 68 at the end 50 of roller 14. The outer diameter of anti-friction rings 56 may be slightly smaller than the outer diameter of roller 14, as shown in FIG. 5, so that the rings do not interfere with squeegee roller 16 and cleaner roller 18 (FIGS. 1-3) engaging developer roller 14.

Referring specifically to FIGS. 6 and 7, anti-friction rings 56 are secured in place, for example, with push-on retainers 58. Push-on retainers 58 may be desirable, for example, to secure rings 56 pre-flexed with a concave shape (bowed outward at the center of the ring) to help keep the rings flat when installed. A push-on retainer 58 takes advantage of the outboard force at the center of the ring for a more secure fit to hold the ring flat against the end of roller 14. Arrows 72 and 74 in FIGS. 6 and 7 indicated the installation sequence for rings 56 and retainers 58, respectively.

As noted above, the examples shown in the figures and described herein illustrate but do not limit the scope of the patent, which is defined in the following Claims.

"A", "an" and "the" used in the claims means one or more.

The invention claimed is:

1. A sealing system for a developer roller in a liquid electrophotographic printer, comprising:

a pair of arcuate seals each with an annular sealing surface to seal one end of the developer roller;

a pair of washers each having a low friction surface to contact one of the sealing surfaces, each washer pre-flexed with a concave shape; and a pair of retainers each to hold one of the washers flat against the end of the roller.

2. The sealing system of claim 1, where the developer roller includes a shaft and each retainer comprises a push-on retainer to bear on the shaft to hold the corresponding washer flat against the end of the roller.

3. A group of parts for a developer unit in a liquid electrophotographic printer, comprising:

a developer roller;

a shaft extending axially from each end of the roller;

multiple anti-friction rings each having a low friction surface to encircle the shaft at one end of the developer roller; and multiple push-on retainers each to press one of the anti-friction rings against one end of the developer roller.

4. The group of claim 3, where each anti-friction ring is concave to be flattened against the end of the developer roller with one of the retainers.

5. The group of claim 3, where an outer diameter of each anti-friction ring is less than an outer diameter of the developer roller.

6. A developer roller assembly for liquid electrophotographic printing, comprising:

a developer roller including a conductive core and a compliant exterior surrounding the core;

a shaft extending axially from each end of the developer roller;

a flat anti-friction ring encircling the shaft on each end of the developer roller, each anti-friction ring having a low friction outboard surface facing away from the end of the roller; and a push-on retainer pressing each anti-friction ring against the corresponding end of the developer roller.

7. The roller assembly of claim 6, comprising a seal pressed against the low friction surface of the anti-friction ring at each end of the developer roller.

8. The roller assembly of claim 6, where each anti-friction ring comprises a washer pre-flexed to a concave shape and flattened against the end of the developer roller with one of the retainers.

9. The roller assembly of claim 6, where the low friction surface on each anti-friction ring is made of polytetrafluoroethylene.

10. The roller assembly of claim 9, where each anti-friction ring is made of polytetrafluoroethylene.

11. The roller of claim 6, where the compliant exterior wraps around the ends of the conductive cylinder and each anti-friction ring is pressed against the compliant exterior.

* * * * *